United States Patent [19]

Braid

[11] 4,103,724

[45] Aug. 1, 1978

[54] LOG SPLITTING MACHINE

[76] Inventor: Murray D. Braid, 8126 Middlesex Rd., Mentor, Ohio 44060

[21] Appl. No.: 755,251

[22] Filed: Dec. 29, 1976

[51] Int. Cl.[2] ..... B27L 7/00

[52] U.S. Cl. ..... 144/193 A; 144/193 E; 254/104

[58] Field of Search ..... 144/193 R, 193 A, 193 B, 144/193 C, 193 D, 193 E, 193 F, 193 G, 193 H, 3 K; 254/104

[56] References Cited

U.S. PATENT DOCUMENTS

| | | | |
|---|---|---|---|
| 508,020 | 11/1893 | Ivey | 144/193 R |
| 2,851,072 | 9/1958 | Gerjets et al. | 144/193 A |
| 3,280,864 | 10/1966 | Spanenberg | 144/193 A |
| 3,285,304 | 11/1966 | Fuller | 144/193 A |
| 3,938,567 | 2/1976 | Dircksen et al. | 144/193 A |
| 4,019,549 | 4/1977 | Williams | 144/193 A |

*Primary Examiner*—Othell M. Simpson
*Assistant Examiner*—W. D. Bray

[57] ABSTRACT

A log splitter for longitudinally splitting a log comprises a support for supporting the log to be split. A double angled wedge structure is located at one end of the support to engage one end of the log and a ram is located to engage the other end of the log. A hydraulic means moves the ram to force the one end of the log against the double angled wedge structure. The double angled wedge structure comprises a pair of plates extending transverse to the direction of movement of the ram, each of said pair of plates having first portions which converge at one angle as they extend toward the one end of the log and second portions which converge at another lesser angle as they extend toward the one end of the log from said first portions.

4 Claims, 4 Drawing Figures

LOG SPLITTING MACHINE

BACKGROUND AND SUMMARY OF THE PRESENT INVENTION

The present invention relates to a log splitter and particularly to a log splitter of the type which supports a log between a ram and a wedge and where the ram engages one end of the log and moves the log into forceful engagement with the sharp edge of the wedge and continues the movement of the log relative to the wedge to effect a splitting of the log. In such log splitters the sharp edge of the wedge penetrates the end of the log and as the log continues to move relative to the wedge the side surfaces of the wedge will force the log to split. Such log splitters as noted above are known. U.S. Pat. No. 3,077,214 discloses a typical example of such a log splitter.

The present invention is directed to a log splitter of the above-noted type which is primarily for the home owner who splits his own fireplace wood. The log splitter of the present invention is a compact relatively inexpensive construction as compared to the prior art and is small enough to easily move around on wheels which form a part of the structure of the present invention.

In particular, the log splitter of the present invention is designed with a double angle wedge construction which includes a very sharp angle point for the initial penetration of the log and a wider angle portion for purposes of accelerating the spreading or splitting of the log.

The wedge construction of the present invention is a double angled construction where the point of the wedge is formed at an angle of approximately 20° which is a very sharp angle as compared to the conventional wedges of 25° to 30° and which enables the initial penetration of the log to occur with less force on the ram. The wider angle on the wedge is approximately 80°, and when this portion of the wedge engages the log it effects an accelerated rate of separation of the portions of the log relative to the longitudinal travel of the ram.

As a result of the double angle construction of the wedge the total ram travel is shorter for a given log as compared to the prior art which does not include a double edge angle wedge. Since a shorter stroke on the ram is enabled by the present wedge construction, a lower cost hydraulic cylinder can be used instead of the longer stroke cylinder required with the conventional one angle wedge construction.

Further, the double angle wedge structure of the present invention is formed of a pair of plates which extend transverse to the direction of movement of the ram. Each of the plates has first portions which converge at one angle, namely at the angle of approximately 80° and other portions which converge at the angle of approximately 20°. These plates are suitably bent in order to provide the different angles. The plates are interconnected by a plurality of rectangularly shaped supports which function to reinforce the wedge structure and provide rigidity. This structure is simple and quite effective.

U.S. Pat. No. 3,077,214 appears to provide for accelerating the slipping of a log by the use of a wide angle plate located on top of the splitting wedge. This patent however does not provide a double angle wedge construction formed of a pair of plates as discussed above and as will be defined in detail herein. The plate which forms the second or spreading angle of U.S. Pat. No. 3,077,214 is subject to the problem of a log being moved thereunder. In fact, it clearly would not engage logs of relatively small diameter.

DESCRIPTION OF THE FIGURES

Further features and objects of the present invention will be apparent to those skilled in the art to which it relates from the following detailed description of a preferred embodiment of the present invention made with reference to the accompanying drawings in which.

As noted hereinabove, the present invention relates to a log splitter and particularly relates to a log splitter of the type which includes a ram for moving a log longitudinally into a wedge and where the action of the wedge and ram combine to effect the splitting of the log as the log continues to move relative to the wedge. The present invention is particularly centered around a wedge construction which may be used in a variety of different log splitters.

Figure 1:
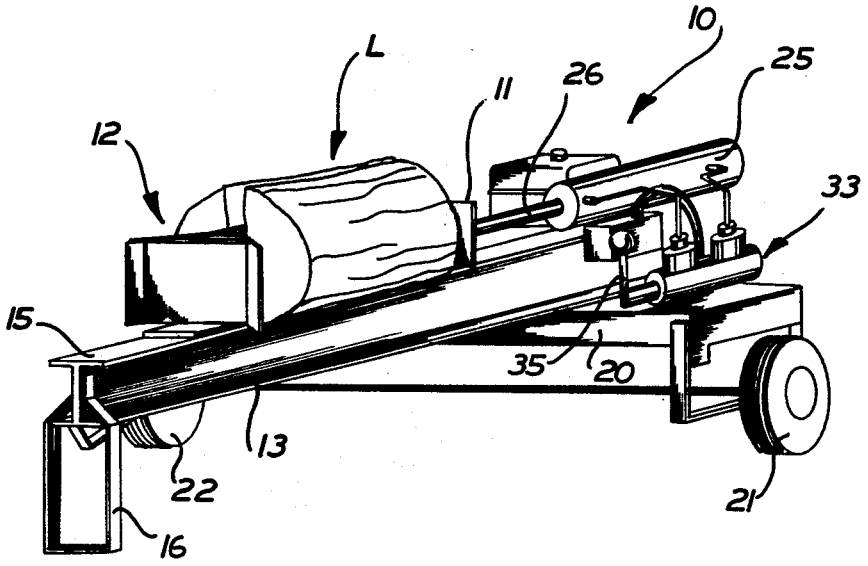
FIGS. 1 and 2 are perspective views illustrating a log splitter embodying the present invention.
Figure 2:
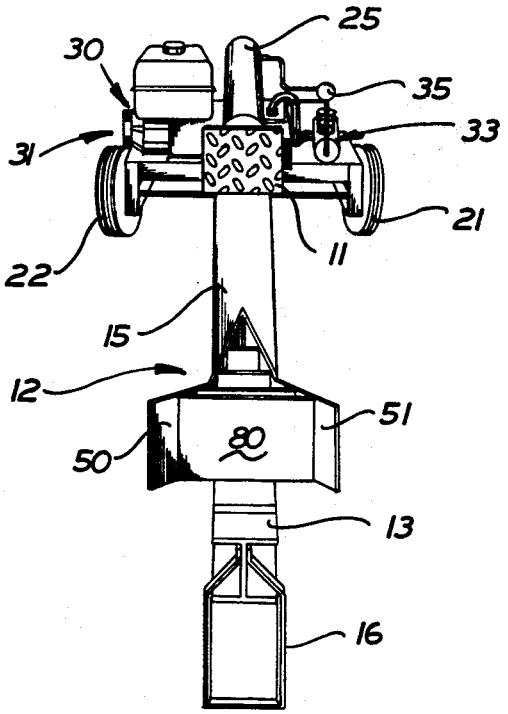

As representative of the present invention, FIG. 1 illustrates a log splitter generally designated 10 and which embodies the present invention. The log splitter 10 includes a ram 11 and a wedge construction 12 located at opposite ends of a log support 13. The log support 13 is an I-beam support and has an upper horizontally extending surface 15 on which a log L to be split is positioned.

The end of the I-beam 13 which is adjacent the wedge has a ground support 16 extending downwardly therefrom. The support 16 extends downwardly from the beam 13 to engage the ground and provide for a generally horizontal disposition of the log L when the log is to be split. The rear of the beam 13 is connected with and supported by a carriage 20. The carriage 20 has wheels 21 and 22 connected therewith which enable the log splitter to be manually moved rather easily from place to place. Such movement can be effected by merely lifting the end of the support 13 which is adjacent to the wedge and pushing or pulling the log splitters and it will roll along the ground due to the wheels 21 and 22.

The carriage 20 supports a suitable gasoline engine 30. The gasoline engine 30 operates a pump 31 which has a reservoir providing a supply of hydraulic fluid. The reservoir is defined by and forms a part of the carriage 20. The pump directs fluid through a suitable fluid circuit which includes a valve 33. The valve 33 is of a conventional construction and will not be described in detail. The valve 33 is four-way valve which is spring centered and which is manually operated. The valve in its center position enables fluid to flow therethrough from the pump back to the reservoir in an "open centered" manner. Movement of the valve in one direction will cause fluid to be ported to one end of the hydraulic cylinder 25. When hydraulic fluid is ported to the hydraulic cylinder 25 the ram 11 is moved under force of the fluid pressure to engage the one end of the log L and force the log against the wedge structure 12. The ram 11 is mounted on the end of rod 26 of the cylinder 25. The valve when it is moved in the opposite direction will cause reverse movement of the ram 11 due to porting of fluid to the other end of the hydraulic cylinder 25.

The valve 33 is actuated by a suitable manually operated handle 35.

The operation of the device should now be clear. The log L is placed on the support surface 15 between the wedge structure 12 and the ram 11. The handle is then moved in the proper direction in order to actuate the valve 33 to port fluid to the hydraulic cylinder 25 to move the ram 11 into engagement with the one end of the log and to cause the ram to force the log against the wedge structure 12. The ram 11 moves the log against the wedge structure and continues the movement of the log and as a result the log is penetrated by the sharp edge point of the wedge structure 12 and then is split as the log continues to move relative to the wedge 12. When the handle 35 is released the movement of the ram 11 is stopped and movement of the handle 35 in an opposite direction will cause the ram 11 to withdraw.

Figure 3:
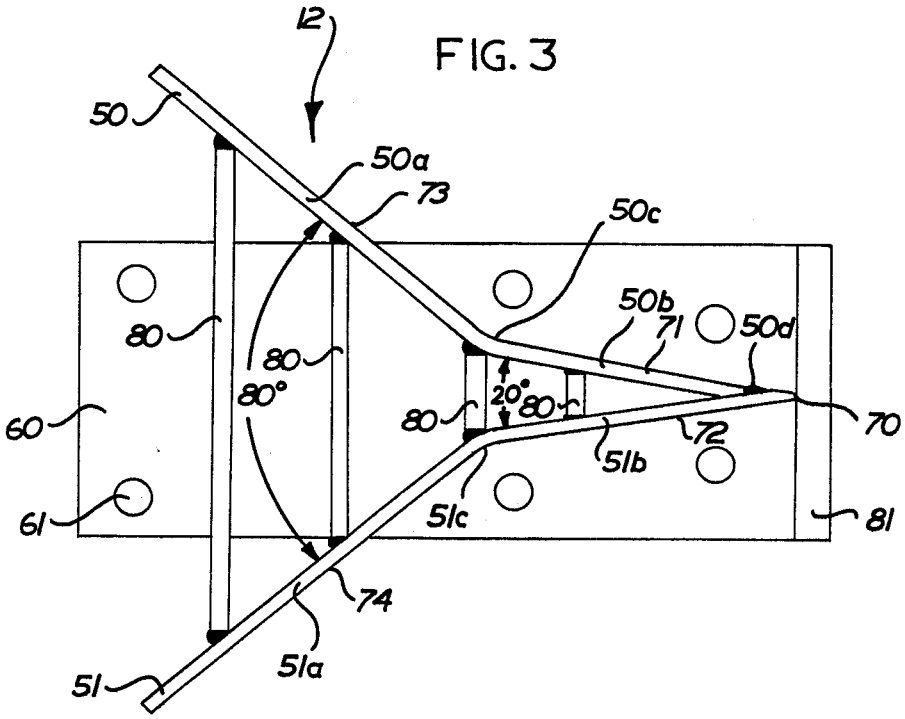
FIG. 3 is a top plan view of the wedge construction embodied in the log splitter of FIGS. 1 and 2.
Figure 4:
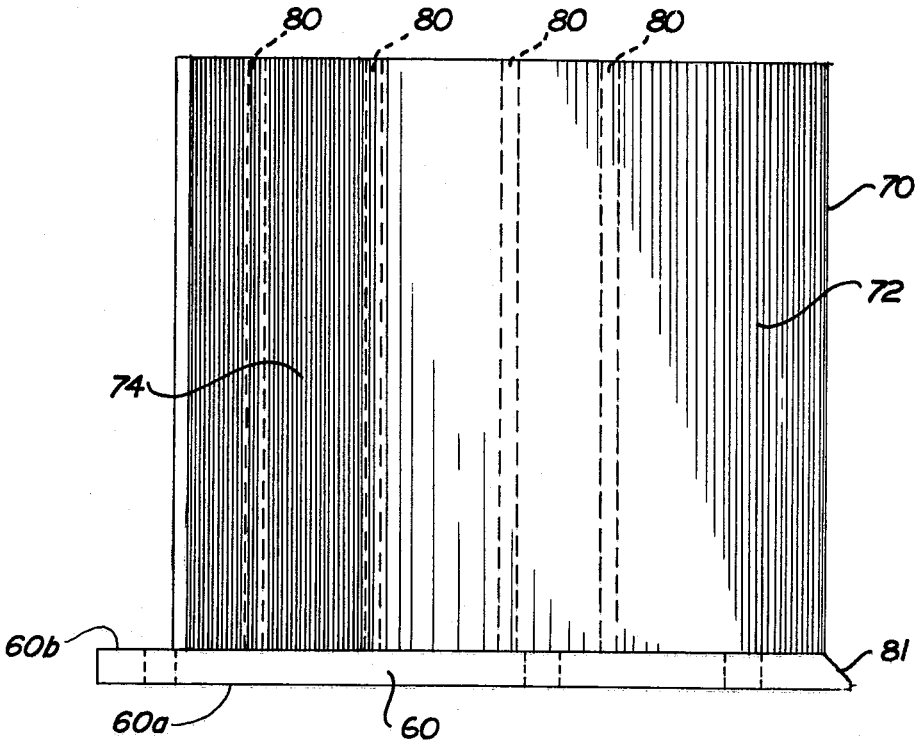
FIG. 4 is a side elevational view of the wedge construction of the log splitter of FIGS. 1 and 2.

As noted hereinabove, the present invention is particularly directed to the wedge structure 12 which is embodied in the log splitter 10. The wedge structure 12 is best shown in FIGS. 3 and 4. The wedge structure specifically is a double angled wedge which is manufactured from a series of steel plates all of which are of substantially rectangular construction.

Specifically, the wedge structure 12 is made of a pair of plates 50 and 51. The plates 50 and 51 extend transverse to the axis of the log L and transverse to the direction of movement of the ram 11. As shown in the drawings, the plates 50, 51 extend perpendicular to the surface 15.

The plate 50 includes a portion **50*a* and a portion 50*b* which extend at an angle to each other. The transition zone between the portions 50*a* and 50*b* is a radius designated 50*c* where the plate 50 has been bent. The plate 51 has a portion 51*a* and a portion 51*b* which extend at an angle to each other and the transition zone between the portions 51*a* and 51*b* is at 51*c* which is a radius area where the plate 51** has been bent.

The plates 50 and 51 are suitably secured together as by welding to a base plate 60. The base plate 60 has a plurality of openings 61 for receiving bolts that secure the wedge structure 12 to the support. The base plate 60 has first and second major surfaces **60*a*, 60*b*, respectively, which are generally parallel. The first surface 60*a* is in contact with the support. The second surface 60*b* has the plates 50, 51** welded thereto.

The wedge structure 12 can be located on the support 15 in a desired position by merely removing the bolts that extend through the plate 60 and positioning the wedge along the surface 15 of the support 13. This adjustment is enabled by having the bolts extend through holes in the upper surface of the support 13. The support 13 has a series of bolt holes spaced longitudinally therealong. By removing the bolts from one set of holes and locating them in another set of holes the wedge structure 12 can be positioned along the support 13 to a new location.

The plates 50 and 51 are located on the base plate 60 in such a manner that they form a double angled wedge. Specifically the portions **50*a* and 51*a* have an included angle therebetween of approximately 80°. The portions 50*b* and 51*b* have an included angle therebetween of approximately 20°. As best shown in FIG. 3 it should be apparent that the portion 51*b* projects somewhat forwardly (toward the log L) of the portion 50*b*. A suitable weld 50*d* is provided to secure the forward position of 51*b* and 50*b* together. This weld is suitably ground to provide a smooth log penetrating angle. The forwardly projecting portion terminates in a splitting edge 70 which extends transverse to the axis of the log and also transverse to the direction of movement of the ram. The edge 70** is the penetrating edge which initially penetrates the log to initiate the splitting action.

Once the log is initially penetrated by the edge 70, the very sharp angled portion of the wedge structure 12 which is formed by the portions **50*b*, 51*b* sharply pentrates the log rather easily because of the small angle of approximately 20° defined therebetween. As the log is moved by the ram 11 the outer surface portions 71 and 72 respectively of the portions 50*b*, 51*b*** engage portions of the log and force the log to separate at a rate which is related to rate of movement of the log relative to the wedge structure by the ram.

The portions **50*a*, 51*a* of the plates 50, 51, respectively, have outer surfaces 73, 74, respectively. When the portions of the log which are being split engage the outer surfaces 73, 74 those surfaces force the log to split apart at a more rapid rate per increment of movement of the ram, as compared to the action of the surfaces 71 and 72. As a result, the splitting action of the log is greatly accelerated once the log engages the surfaces 73 and 74**.

In order to provide a strong rigid double angled wedge structure 12, a series of interconnecting support plates 80 are provided as reinforcement. The support plates 80 are suitably secured as by welding to the base plate 60 and also to the plates 50 and 51. The reinforcing plates 80 extend parallel to each other and are located between the plates 50, 51.

The wedge structure 12 also at its forward end adjacent the splitting edge 70 is provided with a ramp 81. The ramp 81 as best shown in FIG. 4 is formed on the forward side of the plate 60 and is formed at an angle of about 45° to the upper surface 15 of the support 13. The ramp 81 provides for an upward camming action of the log L as it is moved toward the wedge structure 12 to thereby insure that the log is properly engaged with the splitting edge 70 of the wedge structure 12.

From the above it should be apparent that applicant has provided a substantially improved log splitter which requires less total ram travel, and therefore a shorter stroke, lower cost hydraulic cylinder can be utilized rather than the longer stroke cylinders required on splitters with the conventional one angle wedge. It should further be apparent that the double angle wedge structure 12 extends a full height of approximately eight inches from the support surface 15, thus providing spreading action to all logs including logs which are small in diameter. It should further be apparent that the wedge structure 12 consists of a plurality of pieces of sheet steel all of which are substantially rectangularly shaped, and thus the need for expensive contour machining of angle shapes is not required.

Having described my invention, I claim:

1. A manually movable log splitter for longitudinally splitting a log comprising a support having a horizontally extending surface for supporting the log to be split, a base plate having first and second major surfaces which extend generally parallel, said first major surface being in contact with said horizontally extending surface of said support, a double-angled wedge structure secured to said second major surface and located at one end of said support to engage one end of a log, a ram for engaging the other end of the log, means for adjustably securing said plate to said horizontally extending surface of said support to adjustably position the double-angled wedge structure along said horizontally extending surface of said support, hydraulic means for moving the ram to force the one end of the log against the double-angled wedge structure and cause movement of the log relative thereto, said double-angled wedge structure comprising a pair of plates extending transverse to the direction of movement of the ram, each of said pair of plates having first portions which converge at one angle as they extend toward the one end of the log and second portions which converge at another lesser angle as they extend toward the one end of the log from said first portions, said double-angled wedge structure having a splitting edge which extends transverse to the direction of log movement and which engages the one end of the log to initiate splitting thereof, said second portions having outer surfaces which engage the splitting log to force portions of the log apart, said first portions having outer surfaces which engage the splitting log and increase the splitting action per increment of movement of the ram as compared to the splitting action of said second portions, ground-engaging wheels supporting said support, and means on said support which may be manually gripped for moving said log splitter along the ground, said base plate having a first leading side surface extending generally transversely between said first and second major surfaces, said first leading side surface protruding beyond said double-angled wedge structure and having an angled surface to upwardly cam the log toward the splitting edge of said double-angled wedge structure.

2. A log splitter as defined in claim 1 wherein said first portions are converge at an angle of approximately 80° and wherein said second portions converge at an angle of approximately 20°.

3. A manually movable log splitter for longitudinally splitting a log comprising a support having a horizontally extending surface for supporting the log to be split, a base plate having first and second major surfaces which extend generally parallel, said first major surface being in contact with said horizontally extending surface of said support, a double-angled wedge structure secured to said second major surface and located at one end of said support to engage one end of a log, a ram for engaging the other end of the log, means for adjustably securing said base plate to said horizontally extending surface of said support to adjustably position the double-angled wedge structure along said horizontally extending surface of said support, hydraulic means for moving the ram to force the one end of the log against the double-angled wedge structure and cause movement of the log relative thereto, said double-angled wedge structure comprising a pair of plates extending transverse to the direction of movement of the ram, each of said pair of plates having first portions which converge at one angle as they extend toward the one end of the log and second portions which converge at another lesser angle as they extend toward the one end of the log from said first portions, said double-angled wedge structure having a splitting edge which extends transverse to the direction of log movement and which engages the one end of the log to initiate splitting thereof, said second portions having outer surfaces which engage the splitting log to force portions of the log apart, said first portions having outer surfaces which engage the splitting log and increase the splitting action per increment of movement of the ram as compared to the splitting action of said second portions, ground-engaging wheels supporting said support, and means on said support which may be manually gripped for moving said log splitter along the ground, said first portions converge at an angle of apporximately 80° and wherein said second portions converge at an angle of approximately 20°, said base plate having a first leading side surface extending generally transversely between said first and second major surfaces, and said first leading side surface protrudes said double-angled wedge structure and has an angled surface to upwardly cam the log toward the splitting edge of said double-angled wedge structure.

4. A manually movable log splitter for longitudinally splitting a log comprising a support having a horizontally extending surface for supporting the log to be split, a base plate having first and second major surfaces which extend generally parallel, said first major surface being in contact with said horizontally extending surface of said support, a double-angled wedge structure secured to said second major surface and located at one end of said support to engage one end of a log, a ram for engaging the other end of the log, hydraulic means for moving the ram to force the one end of the log against the double-angled wedge structure and cause movement of the log relative thereto, said double-angled wedge structure comprising a pair of plates extending transverse to the direction of movement of the ram, each of said pair of plates having first portions which converge at one angle as they extend toward the one end of the log and second portions which converge at another lesser angle as they extend toward the one end of the log from said first portions, said double-angled wedge structure having a splitting edge which extends transverse to the direction of log movement and which engages the one end of the log to initiate splitting thereof, said second portions having outer surfaces which engage the splitting log to force portions of the log apart, said first portions having outer surfaces which engage the splitting log and increase the splitting action per increment of movement of the ram as compared to the splitting action of said second portions, ground-engaging wheels supporting said support, means on said support which may be manually gripped for moving said log splitter along the ground, said base plate having a first leading side surface extending generally transversely between said first and second major surfaces, said first leading side surface protruding beyond said double-angled wedge structure and having an angled surface to upwardly cam the log toward the splitting edge of said double-angled wedge structure.

* * * * *

UNITED STATES PATENT AND TRADEMARK OFFICE

CERTIFICATE OF CORRECTION

PATENT NO. : 4,103,724

DATED : August 1, 1978

INVENTOR(S) : Murray D. Braid

It is certified that error appears in the above-identified patent and that said Letters Patent are hereby corrected as shown below:

Column 5, line 32 after "portions" delete "are".

Column 6, line 12 change "apporximately" to --approximately--.

Column 6, line 17 after "protrudes" add --beyond--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*